US005242027A

United States Patent [19]

Blum

[11] Patent Number: 5,242,027

[45] Date of Patent: Sep. 7, 1993

[54] CLEANING DEVICE FOR EARTH AUGERS

[75] Inventor: Kenneth J. Blum, Parkville, Mo.

[73] Assignee: Berkel & Company Contractors, Inc., Bonner Springs, Kans.

[21] Appl. No.: 848,352

[22] Filed: Mar. 9, 1992

[51] Int. Cl.[5] ..... E21B 41/00; E21B 12/06

[52] U.S. Cl. ..... 175/84; 175/313

[58] Field of Search ..... 175/84, 207, 394, 313

[56] References Cited

U.S. PATENT DOCUMENTS

| | | | |
|---|---|---|---|
| 1,356,125 | 10/1920 | Chattstrom | 175/84 |
| 3,968,846 | 7/1976 | Brenner | 175/84 |
| 4,364,441 | 12/1982 | Geeting | 175/84 |
| 4,650,012 | 3/1987 | Bollinger et al. | 175/84 |

*Primary Examiner*—Ramon S. Britts
*Assistant Examiner*—Frank S. Tsay
*Attorney, Agent, or Firm*—Hovey, Williams, Timmons & Collins

[57] ABSTRACT

Apparatus (30) is disclosed for preventing accumulation of debris such as clay, dirt or stones in the flighting (28) of an elongated earth auger (12) so that when the auger is removed from a bore hole while continuing to rotate, accumulated debris is not left in the flights which could fall on adjacent workmen or equipment. The apparatus includes a fan-shaped flight cleaning device (76) having a rotatable hub (80) which carries a series of radially extending, co-planar petal elements (82) adapted to successively extend into the auger flighting to dislodge debris tending to accumulate in the flights. As the auger rotates, the flighting engages the edges of the petal elements to cause the cleaning device to rotate and successively bring the petal elements into the area between adjacent flight sections for dislodgement of debris tending to accumulate in such areas. Pivotal mounting means (60, 84) for the flight cleaning device (58) allows the device to be deflectable as necessary to clear cylindrical connector collars of the auger, or to swing out of the way when a debris dislodgement element encounters debris wedged in the auger flighting that could damage the cleaning device.

8 Claims, 1 Drawing Sheet

CLEANING DEVICE FOR EARTH AUGERS

BACKGROUND OF THE INVENTION

1. Field of the Invention

This invention relates to apparatus for preventing accumulation of debris such as clay, dirt or stones in the flighting of an elongated earth auger which could fall on adjacent workmen or equipment as the auger is being removed from a bore hole while continuing to rotate.

Although the cleaning device of this invention may be used on various types of earth augers, it has particular utility for preventing clay, dirt or rocks from accumulating in the flighting of earth augers employed to dig bore holes which ultimately receive concrete to form a pier. Earth augers of this type generally have a central hollow shaft for delivery of cementious material as the auger is withdrawn from the bore hole. Problems have been encountered in instances where clay, dirt, stones or mixtures of this debris collect in the auger flighting so that as the auger is withdrawn, the debris may becomes dislodged from the auger flights and fall onto adjacent workmen or equipment. Continued rotation of the auger as it is being withdrawn from the bore hole exacerbates the tendency of material which has accumulated in the auger flighting to be flung therefrom from the auger onto personnel around the auger, or onto adjacent equipment, tending in many instances to damage such equipment.

2. Description of the Prior Art

A typical auger for drilling bore holes to be filled with cementious material to present a pier, or for other purposes, is illustrated in my prior U.S. Pat. No. 4,966,498. As schematically depicted in that patent, an auger 22 is suspended from a upright, box-like support frame which rests on the ground and extends upwardly from the area in which a bore hole is to be drilled. A crane or other similar unit may be employed to maintain the upright frame in its essentially vertical disposition.

As the auger is rotated about its longitudinal axis in a direction to cause the auger to dig a cylindrical bore hole in the ground, clay or dirt elevated to the surface of the ground by the auger flighting is deposited in the annular area surrounding the auger. When a bore hole of required depth has been formed, the auger is lifted from the hole while rotation thereof is continued in order to provide assurance that the bore hole will retain essentially its desired cylindrical shape.

Rotation of the auger during withdrawal increases the likelihood though that any clay, dirt, rock or mixtures thereof that has accumulated in the auger flighting will be thrown from the auger by centrifugal force, thereby endangering adjacent workmen or equipment. The problem is especially acute in connection with heavy clays which can substantially fill the spiral space defined by the auger flights, and become dislodged from the auger after a section thereof completely or partially filled with clay clears ground level as the auger is retracted from the bore hole.

In view of the fact that bore holes formed in the ground to receive concrete which presents piers or the like are usually relatively deep, it is the usual practice to dig such holes with an auger that is made up a number of connected, end-to-end auger sections. This is dictated at least in part by the fact that the auger can be handled and transported only when it is constructed of individual, end-to-end sections, which upon dismantling are of a size that can be loaded on trucks for over the road transfer from one job site to another.

It is apparent therefor, that any device to be used for the purpose of cleaning out clay, dirt or stones that tends to accumulate in the flighting of an earth auger should meet at least two criteria. First, the cleaning device must be capable of accommodating cylindrical connectors used to join adjacent auger sections in end-to-end relationship. Second, the cleaning device must be deflectable when a cleaning element thereof encounters debris wedged in the auger flighting to a degree that upon engagement of a cleaning element of the device with such debris, damage to the cleaning device would occur.

SUMMARY OF THE INVENTION

The apparatus of this invention is operable to dislodged debris such as clay, dirt or stones which tend to accumulate in the flighting of an elongated earth auger during use thereof, so that the debris will not become dislodged from the auger flighting as the latter is withdrawn from a bore hole, and thereby endanger adjacent workmen or equipment.

The apparatus includes a fan-shaped cleaning device rotatable about an axis permitting the individual petal-shaped elements of the device to successively move into a fixed position between adjacent flight sections of the auger. Mounting structure pivotally supporting the fan-shaped cleaning device in proximal relationship to the auger during use thereof, positions the cleaning device such that the auger flighting engages the petal-shaped elements to rotate the cleaning device and thereby bring the petal elements successively into the space between adjacent auger flight sections.

As the petal-shaped elements of the cleaning device are directed into the space between proximal auger flight surfaces, each of the elements serves to rid the space between auger flight sections of debris tending to accumulate in such space.

The mounting means for the cleaning device which allow free rotation thereof about the axis of the fan-shaped device, is also constructed in a manner which allows the cleaning device to swing as a unit in directions such that a petal-shaped cleaning element interposed between flight sections of the auger, is not subjected to damaging forces when the element encounters debris in the auger flighting which is wedged so tightly that the element would be bent or otherwise deformed before dislodgement of the accumulated debris.

In like manner, the mounting means for the cleaning device permits the latter to swing out of the way of any cylindrical connectors used to join adjacent individual sections of the auger.

DESCRIPTION OF THE DRAWINGS

Figures 1, 2, 3:
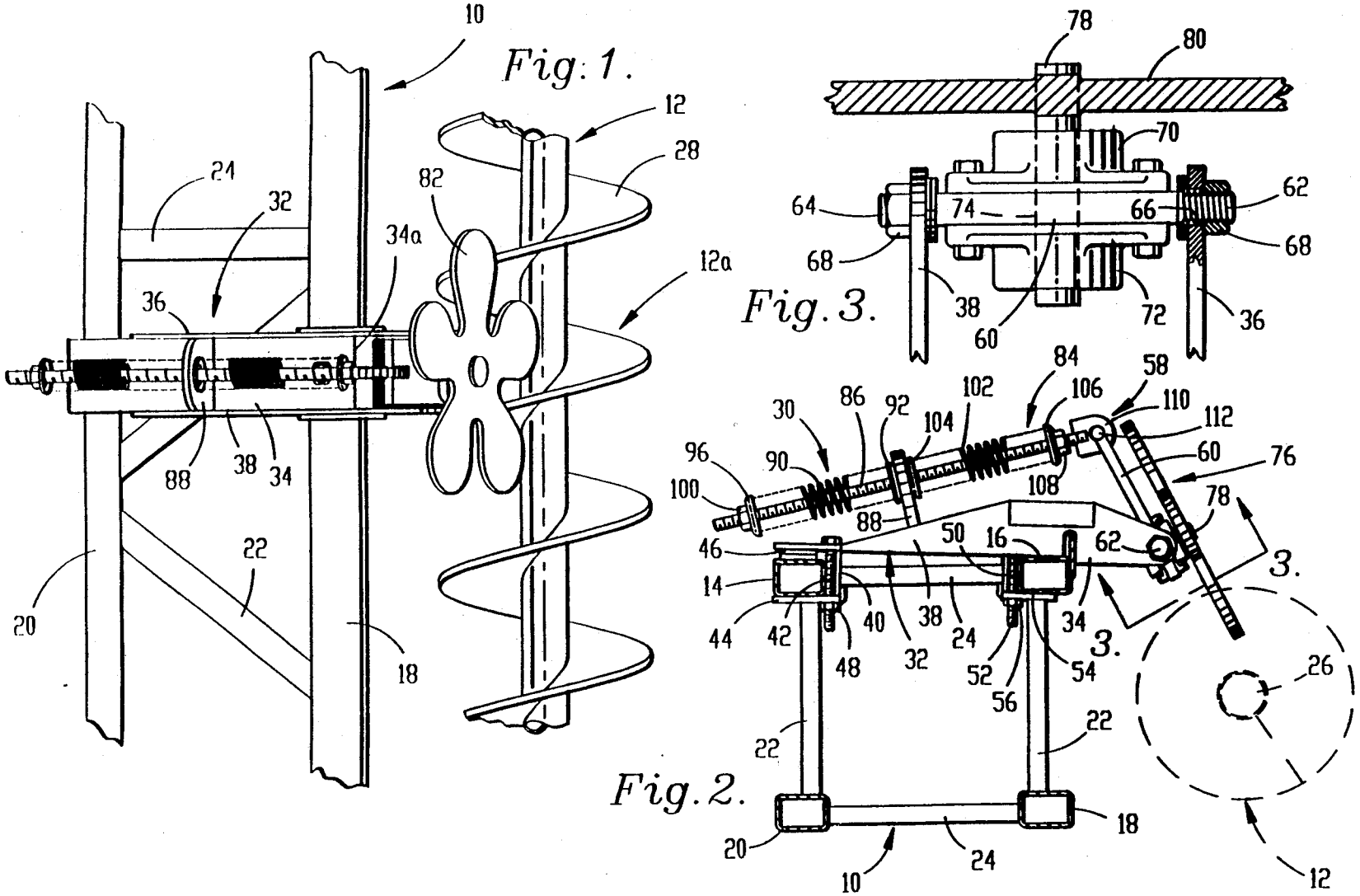
FIG. 1 is a side elevational view of auger cleaning apparatus constructed in accordance with a preferred embodiment of the invention and illustrating the apparatus as being supported by an upright frame assembly depicted in fragmentary form, and in disposition to clean out the spiral space between the flights of an auger, also shown only fragmentarily.
FIG. 2 is a plane view of the auger cleaning apparatus of the present invention and again illustrating the apparatus mounted on an upright frame assembly and with the auger to be cleaned by the apparatus shown by dash lines.
FIG. 3 is an enlarged vertical cross-sectional view taken essentially along the line 3—3 of FIG. 2 and looking in the direction of the arrows.

In FIG. 1, a typical upright frame assembly is broadly designated 10 for supporting auger 12 in disposition for drilling of a bore hole (not shown) in the ground. Frame assembly 10 has four elongated upright frame members 14, 16, 18 and 20 joined by angularly disposed cross braces 22 and transverse connector members 24. As depicted in my prior U.S. Pat. No. 4,966,498, frame assembly 10 is normally suspended in an upright position from the boom of a crane or other suitable piece of equipment, and rests on the ground in vertical orientation.

Auger 12 generally is comprised of a number of separate sections, only one section 12*a* being shown in the drawings. Auger section 12*a* preferably is of the type that has a central shaft 26 in the nature of a hollow pipe which supports a helical flight 28 welded to the outer surface thereof. In a typical auger section, the pitch of flighting 28 is usually about 9 inches and the diameter of the auger is nominally 12–18 inches.

The auger cleaning apparatus 30 of this invention includes a main mounting unit 32 made up of an elongated rectangular plate 34 provided with upright side flanges 36 and 38 welded to the side edges thereof. It can be seen from FIG. 1 that the right hand end 34*a* of plate 34 terminates in spaced relationship from the outermost proximal extremities of side flanges 36 and 38, thus leaving a free area between the right ends of flanges 36 and 38.

A connector plate 40 welded to the face of main plate 34 opposed to side flanges 36 and 38 adjacent the left hand end of plate 34 viewing FIG. 2, is strategically located to be positioned adjacent an upright surface of frame member 14 between vertically spaced connector members 24 joined to frame members 14 and 16. The main plate 34 of mounting unit 32 has an opening therein for receiving a bolt 42 which also extends through an outer coupling member 44 adapted to lie against an inner face of frame member 14 in perpendicular relationship to plate 40. If desired, shims 46 may be affixed to the outer face of plate 34 outboard of bolt 42, in disposition to engage the outer proximal face of frame member 14. Nut 48 on bolt 42 permits tightening of the coupling member 44 against frame member 14.

In like manner, a plate 50 welded to the outer face of main plate 34 in parallel relationship to plate 40 is located so that it will be positioned proximal to frame member 16. A hole in main plate 34 receives a bolt 52 which extends through outer coupling member 54. Nut 56 serves to force coupling member 54 into tight engagement with the inner face of frame member 16.

A flight cleaning device broadly designated 58 is pivotally carried by mounting unit 32 between the free ends of side flanges 36 and 38. Device 58 is provided with an elongated rectangular plate 60 having externally threaded bosses 62 and 64 secured to opposed edges thereof at one end of the plate in co-axial relationship and projecting outwardly in opposite directions from the plate 60. It can be seen from FIG. 3 that bosses 62 and 64 extend through suitable openings 66 therefor with nuts 68 being threaded over the outermost ends of bosses 62 and 64 which project through respective side flanges 36 and 38. Plate 60 is thus free to rotate about the aligned axes of bosses 62 and 64 relative to mounting unit 32.

Device 58 further includes a pair of bearings 70 and 72 which are bolted to opposed planar faces of rectangular plate 60 in proximal relationship to threaded bosses 62 and 64. Plate 60 has an opening 74 therethrough aligned with the co-axial passages defined by barings 70 and 72.

Said fan-shaped member 76 is mounted on plate 60 and includes a shaft 78 which passes through the aligned openings of barins 70 and 72 as well as openings 74 in plate 60. Member 76 has a central planar hub portion 80 receiving shaft 78 and secured to the latter, as well as five petal-shaped elements 82. As best shown in FIG. 1, each of the petal-shaped elements 82 has an outer peripheral margin or edge 84 which are curvilinear throughout the length thereof. Member 76 and the shaft 78 secured thereto are free to rotate in barings 70 and 72, but are foreclosed from moving axially of shaft 78. It is therefore apparent from FIG. 3 and the preceding description that fan-shaped member 76 may rotate about a first axis defined by shaft 78, and pivot or swing about a second axis co-axial with bosses 60 and 62.

In order to locate device 76 in disposition to effect cleaning of the space between adjacent auger flights 28 of auger 12 after connection of apparatus 30 to frame assembly 10, positioning means 84 is provided on mounting unit 32 and pivotally joined to device 76.

Positioning means 84 includes an elongated threaded rod 86 which is carried by and projects through an upright member 88 welded to the inner face of plate 34 between side flanges 36 and 38. A coil spring 90 is telescoped over the left end of rod 86 viewing FIG. 2 and bears against an inner washer 92 abutting upright member 88, and against an outer washer 96 that is retained on rod 86 by an outer nut 100.

In like manner, a coil spring 102 is telescoped over the right hand end of rod 86 as depicted in FIG. 2 and in turn bears against an inner washer 104 resting against plate 84 and against an outer washer 106 on rod 86. Nut 108 serves to retain the washer 106 in a predetermined position.

The right hand end of rod 86 as shown in FIG. 2 projecting beyond nut 108 is welded to a tongue member 110 that is pivotally received in the end of plate 60 remote from barings 70 and 72. It is to be understood in this respect that the end of plate 60 proximal to positioning means 84 is notched to receive member 110 and has pivot shaft means 112 that is welded to the outer extremity of plate 60 and extends through member 110.

The maximum transverse dimension of each petal-shaped element 82 is less than the distance between adjacent flight sections of auger 12 so that each element may be interposed in the space between proximal flight surfaces as best shown in FIG. 1. Thus, the dimensions of petal-shaped elements 80 are governed by the type of auger in use, and are chosen such that the outermost edge of the auger flight 28 will contact the curvilinear edges of respective elements 82.

Operation of the Preferred Embodiment

In operation, and assuming that apparatus 30 has not as yet been mounted on frame assembly 10, that is accomplished by locating the mounting unit 32 in disposition with plates 40 and 50 between frame members 14 and 16. Nuts 48 and 56 are then manipulated to tighten plates 44 and 54 against respective frame members 14 and 16 to thereby affix apparatus 30 to frame member 10 in transverse relationship thereto. The position of apparatus 30 on frame member 10 is dictated by the area of the auger 12 in which it is desired to keep free of clay, dirt and/or rocks, as well as the side of frame member 10 in which auger 12 is to be located.

It can be seen from FIG. 2, that upon mounting of apparatus 10 on frame assembly 10, the cleaning device 76 is in normal disposition such that a plane through fan-shaped member 76 is in tangential relationship to the outer face of tubular shaft of auger 12. Furthermore, fan-shaped member 76 extends toward auger 12 to an extent that one of the petal-shaped elements 82 is received within the spiral space between adjacent surfaces of the flight sections of auger 12. However, it is to be seen in FIG. 2 that the element 82 of fan-shaped member 76 in closest proximity to auger 12 does not extend into the spiral space defined by auger flights 28 a sufficient distance to cause the edge of element 82 to contact the outer surface of tubular shaft 26 of the auger.

When auger 12 is rotated to drive the auger into the ground and thereby effect formation of a bore hole, device 76 merely freewheels as portions of the auger flight 28 engage the arcuate peripheral surface of member 76 and thereby rotate the fan-shaped member 76. In this manner, petal-shaped elements 82 are successively brought into the space between adjacent auger flight sections as the auger rotates.

Upon completion of digging of a bore hole of desired length, force is exerted on the auger 12 to lift the latter out of the bore hole as the auger means continues to rotate in the original direction. During such extraction of the auger 12 from the bore hole, clay, dirt and/or rocks could fall on workmen or equipment nearby if it were not for removal of such debris from the space between adjacent auger flight sections by device 58.

Each petal-shaped element 82 interposed in the space between adjacent flight sections of auger 12 engage clay, dirt and/or stones remaining in such space to dislodge the debris and directly force the latter out of the auger flights. Thus, as the auger 12 is pulled out of the bore hole, apparatus 30 remains stationarily mounted on frame assembly 10 in a fixed position such that elements 82 serve to strip clay, dirt and/or rocks from the auger flighting.

If auger 12 is made up of a number of end-to-end sections joined by cylindrical connectors of approximately the same diameter as the peripheral edges of flighting 28, when the auger is elevated to a position such that a connector engages an arcuate edge of one of the elements 82 extending into the spiral zone surrounding shaft 26 and auger 12, edge engagement of an element 82 with the cylindrical connector exerts a force on the fan-shaped member 76 to rotate the latter in a counterclockwise direction, viewing FIG. 2, against the bias coil spring 102. During this time, plate 60 pivots about the axes of bosses 62 and 64 as rod 86 is shifted to the left as shown in FIG. 2. When the fan-shaped member 76 clears the periphery of the cylindrical auger connector, spring 102 returns device 76 to its initial fixed auger cleaning position.

Similarly, if the element 82 of fan-shaped member 76 interposed in the space between adjacent sections of auger flighting 28 engages clay, dirt or a mixture thereof with rocks which is wedged into the auger flighting to an extent that the petal 82 of member 76 might be damaged, spring 90 is able to compress to an extent that the fan-shaped member 76 will be deflected and prevent damage to the latter. In this instance, coil spring 90 compresses and plate 60 as well as device 76 rotate in a clockwise direction about the axes of bosses 62 and 64.

The force required to swing flight cleaning device 58 in either of its directions of displacement may be adjusted by repositioning of nuts 100 and 108 respectively along the length of rod 88, thereby changing the compressive forces applied to coil springs 90 and 102.

It should also be noted that the continuous arcuate nature of the edges of petal-shaped elements 82 provides compensation for the spiral configuration of the outer edges of flighting 28 of auger 12 so that successive elements 82 will be smoothly and evenly forced into the space between adjacent flight sections of auger 12. The fan-shaped member 76 thereby operates somewhat like a worm in a worm-gear unit.

I claim:

1. Apparatus for preventing accumulation of debris such as clay, dirt or stones in the flighting of an elongated earth auger assembly having an auger presenting elongated, upright shaft with outwardly extending spiral flighting on the shaft defining a spiral space along the shaft length, said auger assembly including an upright frame adjacent said auger, said apparatus being operable to dislodge the debris from the spiral space surrounding the shaft as the auger is actually rotated during withdrawal thereof from a bore hole in the ground and comprising:

a rotatable flight cleaning device having a central hub defining the axis of rotation of the device, and a plurality of debris dislodging elements secured to and extending outwardly from the hub that may be interposed in the spiral space between the auger flights as the auger is rotated to remove debris that tends to accumulate in said spiral space;

means for rotatably supporting the device in a rest position adjacent an auger that is being rotated and withdrawn from a bore hole with at least one of the elements of the device interposed in the spiral space, said elements being operable in said rest position of the device to successively move into the spiral space adjacent said rest position of the device in timed relationship to rotation of the auger and axial withdrawal thereof from said bore hole, said device-supporting means including structure permitting alternate swinging movement of the device in respective, opposite directions about a second axis transverse to said hub axis when one of said elements encounters an obstruction, and spring means for biasing said device back to said rest position when the device has been swung in either of said opposite directions and after said obstruction has been cleared; and means for operatively connecting said device-supporting means to said upright frame and adjacent said auger.

2. Apparatus as set forth in claim 1 including hub mounting means for allowing free rotation of the hub and thereby said elements thereon about the axis of the hub.

3. Apparatus as set forth in claim 1, wherein said spring means includes two counterbalancing springs for retaining the device in said rest position thereof and operable to allow the device to swing about said second axis in said opposite directions from its rest position.

4. Apparatus as set forth in claim 1 wherein said hub and the elements cooperate to present a fan shaped member with each of the elements being of generally petal-shaped configuration.

5. Apparatus as set forth in claim 4 wherein said fan-shaped member is provided with at least five of said petal-shaped elements arranged in symmetrically spaced relationship with respect to the hub.

6. Apparatus as set forth in claim 4 wherein each of the petal-shaped elements has a curvilinear outer edge.

7. Apparatus as set forth in claim 4, wherein the maximum transverse width of each of the petal-shaped elements is dimensioned to be approximately one-half of the distance between adjacent sections of said spiral flighting.

8. Apparatus as set forth in claim 1, wherein said elements are of substantially planar configuration and lie in an essentially common plane, said hub and the supporting means therefor being oriented to cause the device to be located such that in said rest position thereof, the elements lie in a plane that is generally tangential to the shaft of said auger.

* * * * *